United States Patent [19]

Eun

[11] Patent Number: 4,813,866

[45] Date of Patent: Mar. 21, 1989

[54] GAS EJECTION NOZZLE DEVICE FOR A CIGARETTE LIGHTER

[75] Inventor: Un K. Eun, Seoul, Rep. of Korea

[73] Assignee: Korea Crown Co., Ltd., Inchon, Rep. of Korea

[21] Appl. No.: 164,420

[22] Filed: Mar. 4, 1988

[30] Foreign Application Priority Data

Aug. 27, 1987 [KR] Rep. of Korea ..... 14365/1987

[51] Int. Cl.[4] ..... F23D 14/28

[52] U.S. Cl. ..... 431/344; 431/132; 431/255

[58] Field of Search ..... 431/344, 132, 255

[56] References Cited

U.S. PATENT DOCUMENTS 4,466,788 8/1984 Nitta ..... 431/344

FOREIGN PATENT DOCUMENTS 122500 10/1984 European Pat. Off. ..... 431/344

*Primary Examiner*—Carroll B. Dority, Jr.

*Attorney, Agent, or Firm*—Birch, Stewart, Kolasch & Birch

[57] ABSTRACT

A gas ejection nozzle device includes a casing, a gas inlet channel extending into a gas ejection channel which has an internal shoulder for forming a larger space than a space of the gas inlet channel, both gas inlet and ejection channels being disposed in the casing, and a dispersing member, disposed in the gas ejection zone, having an aperture for passing the gas and a screwed surface for widely dispersing the gas whereby the gas ejection nozzle device provides to make an ignition easily and stabily maintain the flame of the gas cigarette lighter.

4 Claims, 1 Drawing Sheet

GAS EJECTION NOZZLE DEVICE FOR A CIGARETTE LIGHTER

BACKGROUND OF THE INVENTION

1. Field of the Invention

The present invention relates to a gas ejection nozzle device and more particularly, to a gas nozzle assembly for a cigarette gas lighter, which includes a casing, a gas inlet within the casing, and gas dispersing means, disposed in the gas channel, having an aperture for passage of the gas therethrough and a screwed surface for dispersing the gas widely so as to make ignition easy.

2. Description of the Prior Art

In many of gas ejection nozzle devices for a cigarette gas lighter known in the art, such gas ejection nozzle devices include a straight tube or a tube having a coil-spring disposed therein. In the former, since the gas nozzle has a tubular shaped configuration and the width of the gas jet in the gas nozzle is a relatively narrow, such as in the case of a flint lighter, the ignition is attained easily. However, in the case of a piezo-electronic lighter, the ignition is attained with difficultly. In the latter, a spiral movement is induced of the gas flow in the coil-spring for easily igniting by expanding the width of gas jet. However, the whole gas flow comes to move spirally and the flame of the lighter cannot be stabilized.

SUMMARY OF THE INVENTION

Accordingly, it is an object of the present invention to provide a gas ejection nozzle assembly for a gas cigarette lighter, which is simple in construction and relatively inexpensive to manufacture.

Another object of the present invention is to provide a gas nozzle device for a use in a gas cigarette lighter, which includes a dispersing member, disposed in a gas ejection channel of a gas channel, having an aperture for passing the gas therethrough and a screwed surface for widely dispersing the gas to make ignition easy and stably maintain the flame of the gas cigarette lighter.

A further object of the present invention is to provide a gas nozzle device which is structured with a gas ejection channel containing an internal shoulder which extends into a gas inlet channel for the gas jet in the gas ejection channel so it can be widely expanded and easily ignited by a high voltage spark of a piezo-electronic unit of a gas cigarette lighter.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates a gas ejection nozzle device which includes a casing, a gas inlet channel extending into a gas ejection channel which has an internal shoulder for forming a space larger than a space of the gas inlet channel, both gas inlet and ejection channels being disposed in the casing, and a dispersing member, disposed in the gas ejection zone, having an aperture for passing the gas and a screwed surface for widely dispersing the gas whereby the gas ejection nozzle device provides for easy ignition and stably maintains the flame of the gas cigarette lighter.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
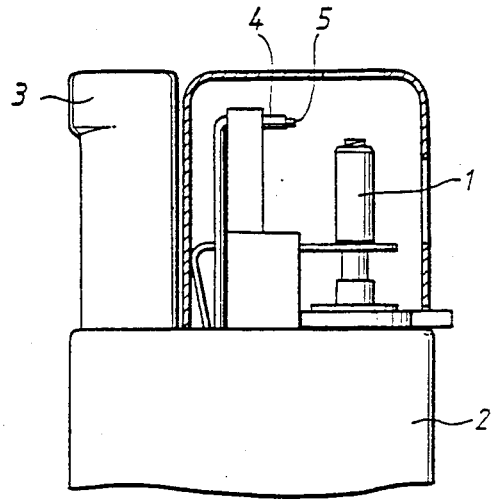
FIG. 1 is a side elevational view of the gas cigarette lighter according to the present invention containing cut-away portion in order to illustrate the construction of a nozzle device of the present invention.

Referring now in detail to the drawings for the purpose of illustrating preferred embodiment of the present invention, the gas ejection nozzle device 1 for a gas cigarette lighter 2 of the present invention, as shown in FIGS. and 2 includes a casing 1', a gas inlet channel 6 extending into a gas ejection channel 8 and both channels 6 and 8 being disposed in the casing 1', and a gas dispersing means 9 inserted into the gas ejection channel 8 for widely dispersing the gas in the gas ejection channel 8. The gas dispersing means 9 inserted in the gas ejection channel 8 is supported by inward protrusions 14.

Figure 2:
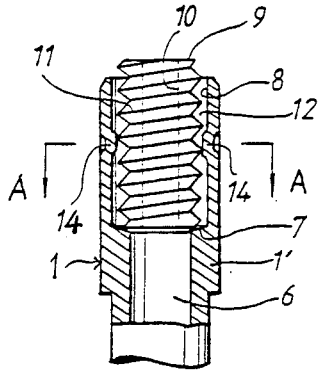
FIG. 2 is a sectional view of a gas ejection nozzle device according to the present invention.
Figure 3:
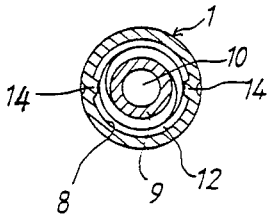
FIG. 3 is a cross-sectional view of FIG. 2 taken along line A—A.

As shown in FIGS. 2 and 3, the gas ejection channel 8 contains an internal shoulder 13 for forming a larger space than a space of the gas inlet channel 6. The gas dispersing means 9 disposed in the gas ejection, channel 8 contains an aperture 10 vertically disposed therein and a screwed surface 11 disposed on the outer surface thereof for widely dispersing the gas in the gas ejection channel 8 to provide for easy ignition and stable maintenance of the flame of the gas cigarette lighter 2. A screwed surface 11 is provided with a plurality of single screws or a plurality of double screws. The casing 1' and the screwed surface 11 define a gas passage zone 12 for spirally moving the gas to generate a centrifugal force of the gas flow and causes it to ignite easily by the high voltage spark generated from a spark tip 5 of a lead 4 of the gas cigarette lighter 2 when the user presses a push button 3 (FIG. 1).

In operation, when the gas is ejected from the gas nozzle assembly by pressing the push button 3, the gas is vertically ascends through the gas inlet channel 6 and aperture 10 disposed in the gas dispersing means 9 and, at this time, the gas is passed through the gas passage zone 12 which is formed between the gas dispersing means 9 and casing 1'. Then, simultaneously, the gas passage zone 12 as well as a plurality of threaded grooves on the screwed surface 11 induce the gas through the gas passage zone 12 to move spirally. Due to an effect of the centrifugal force generating from its movement, the width of the gas jet is widely expanded so that the gas is easily ignited by the high voltage spark generated from the spark tip 5 of the lead 4. Meanwhile, after ignition, the vertical ascending gas through the aperture 10 disposed in the gas dispersing means 9 is stably supplied so that the flame of the gas cigarette lighter 2 is stably maintained.

The following Table I compares the experimental results the gas ejection nozzle assembly 1 of the present invention with so-called a spring nozzle of the prior art in which the whole of the gas moves helically by a coil-spring inserted in the nozzle assembly.

TABLE I

COMPARISON OF THE PRESENT INVENTION WITH PRIOR ART

| | Gas nozzle of the Present invention | Spring nozzle of prior art |
|---|---|---|
| Room temperature: | Normal | Normal |
| −8° C. in 5 min.: | Ignition: good and, Flame: stable | Ignition: bad and, Flame: unstable |
| 37 ~ 40° C. in 5 min.: | Ignition: good and, Flame: stable | Ignition: good and, Flame: spreading |

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A gas ejection nozzle device for a gas cigarette lighter which comprises:

a casing operatively associated with a spark tip disposed in the gas cigarette lighter, said casing defining a gas inlet channel and a gas ejection channel extending therethrough, said gas ejection channel containing an internal shoulder for forming a larger space than a space of said inlet channel, a gas dispersing means inserted within said gas ejection channel, said gas dispersing means including, an aperture vertically disposed therein for passing the gas therethrough, and a screwed surface disposed on the outer surface of said gas dispersing means for widely dispersing the gas in a gas passage zone defined in said casing and said screwed surface, wherein, when the gas in the cigarette lighter is sparked by the spark tip, the gas in the gas passage zone of the nozzle device is easily ignited since the gas moves spirally in a gas jet and generates a centrifugal force due to its movement thereby widely expanding the gas jet, and whereby the flame of the gas cigarette lighter is stably maintained since, after ignition, the gas from the gas ejection channel is stably supplied.

2. The gas ejection nozzle device of claim 1, wherein the gas ejection channel contains a plurality of inward protrusions for supporting the gas dispersing means disposed therein.

3. The gas ejection nozzle device of claim 1, wherein the screwed surface of the gas dispersing means is provided with a plurality of single screws disposed thereon.

4. The gas ejection nozzle device of claim 3, wherein the screwed surface of the gas dispersing means is provided with a plurality of double screws disposed thereon.

* * * * *